US007938747B2

(12) United States Patent
Bothwell

(10) Patent No.: US 7,938,747 B2
(45) Date of Patent: May 10, 2011

(54) GAME RACKET INCLUDING A PIVOT ELEMENT

(76) Inventor: Brett Bothwell, New York, NY (US)

( * ) Notice: Subject to any disclaimer, the term of this patent is extended or adjusted under 35 U.S.C. 154(b) by 230 days.

(21) Appl. No.: 12/072,030

(22) Filed: Feb. 21, 2008

(65) Prior Publication Data

US 2009/0215558 A1 Aug. 27, 2009

(51) Int. Cl.
*A63B 49/02* (2006.01)

(52) U.S. Cl. ..... 473/540; 473/521; 473/548

(58) Field of Classification Search ..... 473/520–522, 473/524, 540, 542, 548
See application file for complete search history.

(56) References Cited

U.S. PATENT DOCUMENTS

| | | | | | |
|---|---|---|---|---|---|
| 360,468 | A * | 4/1887 | Phelps | 473/534 |
| 4,786,055 | A * | 11/1988 | Darling | 473/537 |
| 5,054,779 | A * | 10/1991 | Marrello | 473/522 |
| RE34,420 | E * | 10/1993 | Darling | 473/522 |
| 5,251,895 | A * | 10/1993 | Darling | 473/520 |
| 6,503,161 | B2 * | 1/2003 | Bothwell | 473/540 |
| 6,971,964 | B1 * | 12/2005 | Bothwell | 473/521 |
| 2009/0215558 | A1 * | 8/2009 | Bothwell | 473/540 |

* cited by examiner

*Primary Examiner* — Raleigh W. Chiu

(57) ABSTRACT

The present invention is intended for use as a game racket including a handle and a head frame with strings held in tension. In particular as a high performance game racket frame including at least one generally tubular, substantially circular pivot element located at least partially within a substantially circular mating recess on at least one portion of an outside-facing peripheral surface of the head frame profile that can rotate to cooperate with at least one string. The pivot element can rest upon at least a portion of the mating recess and therefore can have at least one adjoining surface portion. In order to reduce friction, adjoining surface(s) can be coated with a suitable anti-friction agent such as silicone or it can include a "frictionless" repelling permanent magnet portion capable of sustaining magnetic levitation between the two parts. Alternatively, at least a portion of the adjoining surfaces can include communicating electromagnetic friction plates in order to control the rate at which the pivot element rotates.

22 Claims, 4 Drawing Sheets

GAME RACKET INCLUDING A PIVOT ELEMENT

FIELD OF THE INVENTION

The present invention is intended for use as a game racket including a handle and a head frame with strings held in tension. In particular as a high performance game racket frame including at least one pivot element located on at least one portion of the head frame to cooperate with at least one string.

BACKGROUND INFORMATION

Enhancing the response of the stringbed of a game racket is a common theme in the history of racket design. Many designs have included mechanisms such as springs, rollers, levers, etc. in order to improve the response of the strings. The reality of most mechanisms on rackets has been that they were typically too heavy. Modern inflation bladder molding techniques and reinforced plastic construction make it possible now however, to employ similar mechanisms in lighter and more efficient ways.

It's possible now to replicate some of the functions of simple mechanisms like levers, wheels, and springs with lightweight reinforced plastic. Not only can performance of a racket be enhanced with simple, lightweight mechanisms, but they offer a capacity to control of the playing qualities of a racket. A mechanism is an opportunity to have a game racket that responds dynamically to ball impact.

Specifically, the object of the present invention is to employ a pivoting, pulley-like mechanism, made using reinforced plastic and the latest techniques of inflation bladder molding, on an outside-facing surface of a game racket head to improve and potentially to control the racket's performance. It would be a great benefit to have a high performance, lightweight mechanism that increases the effective length of the string while allowing more efficient translation of the ball rebound force at the connection between the string and the frame. It is another object of the present invention to improve the elastic response of the strings of a racket. Another object is to expand the sweet zone on the stringed hitting surface of a game racket. Yet another object of the present invention is to reduce the amount of ball impact shock and vibration transmitted to a player's arm. It is a further objective of the invention to provide an integral protective bumper guard as necessary on the racket head.

To further enhance the performance of a game racket it is another object of the present invention to utilize a spring-like pivot mechanism to flexibly resist torsion brought on by ball impact. Another objective is to have a protective bumper that could serve as both a guard and a spring.

It would be another improvement to have a mechanism on the head frame of a game racket such that the string rebound force could be controlled in an efficient manner. It's another object of the present invention to provide a mechanism on the head frame of a game racket that can be controlled either manually or automatically in order to control the response of the strings. It's still another objective to have a pivoting mechanism on the head frame of a racket capable of being controlled by an electronic signal. It is a further objective to have a pivoting mechanism magnetically levitated in relation to the head frame of a racket in order to achieve a "frictionless" mechanical interaction.

It is another objective to provide the pivot element of the present invention with pre-formed string hole openings and therefore to eliminate the need for protective string grommets. It is yet another object to maximize leverage of a string on a pivot mechanism.

DETAILED DESCRIPTION OF THE INVENTION

Figure 1:
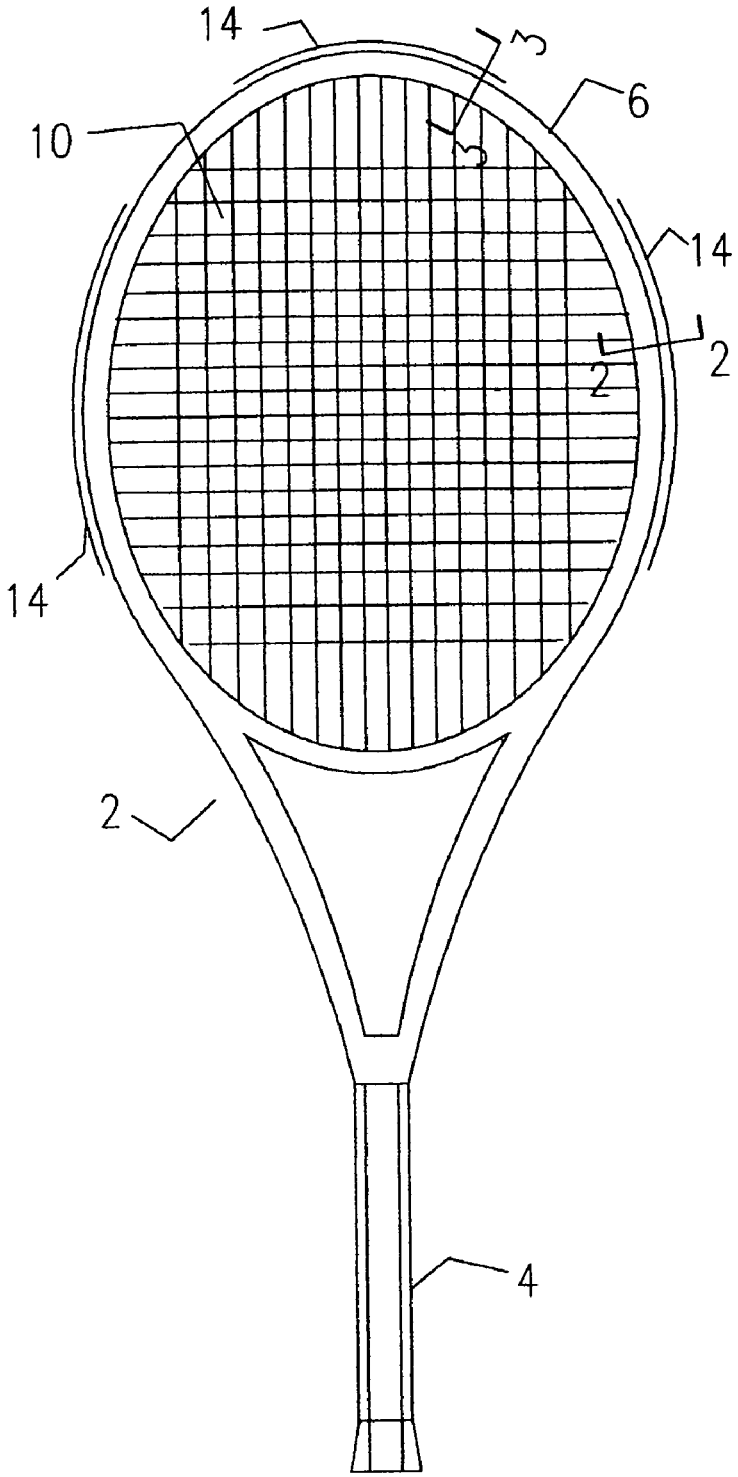
FIG. 1 shows a simplified representation of a game racket including at least one pivot element of the present invention in three possible advantageous locations on the head frame.

According to a preferred embodiment, the present invention is intended for use as a game racket. The racket includes a handle and a head frame laced through with strings in a conventional manner and held in tension to form a stringed hitting surface. In particular, at least one portion of an outer-facing surface of the head frame periphery includes at least one generally tubular pivot element that can rotate to cooperate with at least one string.

Specifically, the generally tubular pivot element of the present invention can be hollow and has a substantially circular closed profile which is located at least partially within a substantially circular mating recess on an outer-facing surface of the head frame periphery. The pivot element can rotate to cooperate with at least one string upon ball impact.

An important trait of the pivot element of the present invention is its adaptability to racket frames with different kinds of string openings through which a string can be laced. The element can work on a frame with a slot-like string channel opening that encompasses a number of strings, or on a frame with more than one string hole opening. Likely other versions of string openings in rackets that can accommodate a pivot element will become apparent to those skilled in the art.

In a particular embodiment, the pivot element profile and the mating recess have at least one adjoining surface. The surface(s) can be coated with a suitable anti-friction agent such as silicone in order to reduce the amount of friction created when the pivot profile rotates. In another embodiment in which a "frictionless" design is desired, the adjoining surface(s) can include at least two opposite and repelling permanent magnets.

In yet a further embodiment of the present invention, at least a portion of an adjoining surface between the pivot profile and the mating recess can serve as communicating electromagnetic friction plate(s). By controlling the surrounding electrical charge, the rate at which the pivot element rotates and therefore the degree to which a string can deflect can be controlled. Control could be effected by manually sending an electronic signal to the friction plate(s) or a signal could be sent automatically by a piezoelectric fiber responding to ball impact.

In yet another embodiment, the pivot element of the present invention can be spring-loaded. A profile of the pivot element can include leaf spring-like wings which can act as a lever(s) to resiliently resist rotation of the pivot element upon ball impact. The wings can also serve the dual purpose of forming an integral protective bumper guard where it may be necessary on the racket head periphery.

In another embodiment, a unitary profile of the pivot element of the present invention can be made of more than one component with at least one common wall and mated in such a way as to have pre-formed string hole openings. This design eliminates the need for a protective string grommet and makes it therefore lighter and with superior feedback characteristics.

The game racket and the pivot element of the present invention can be made using methods known and taught in the previous art of reinforced plastic inflation bladder molding. The present invention is described herein.

FIG. 1 shows a simplified representation of a game racket 2 of the present invention including more than one pivot element on the head frame. The racket 2 includes a handle 4 and a head frame 6 with string(s) 8 laced through and held in tension to form a stringed hitting surface 10. Three potentially advantageous locations for at least one pivot element are indicated on the head frame 6 periphery. The locations suggested here typically are free of string 8 knots and associated complications and also correspond to those string(s) 8 which most directly affect the response of the stringed hitting surface 10 and the area of the sweet spot. Though the representational view of the racket 2 is shown with an open throat portion 6 and a generally oval-shaped stringed hitting area 12, many other configurations are possible within the parameters of reinforced plastic and the inflation bladder molding process and within which the pivot element of the present invention can be equally effective.

The pivot element of the present invention can be employed on game racket frames with different types of openings through which at least one string can pass. FIGS. 2-5 show a number of pivot element(s) 14 on a racket head frame 6 that has string channel opening(s) 24 through which more than one string 8 can be laced through. FIGS. 6-10 show a number of pivot element(s) 14 on a racket head frame 6 having string hole opening(s) 30 that typically accommodate an individual string 8. Though it is these two designs that are relied upon in the diagrams here, other string hole openings are possible and will become apparent to those skilled in the art.

Figure 2:
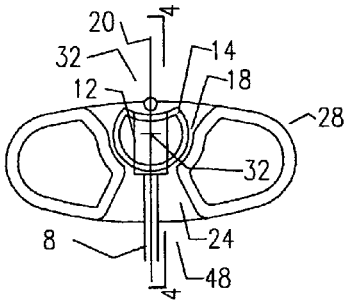
FIG. 2 shows a cross-sectional view corresponding to line 2-2 in FIG. 1 of a first preferred embodiment of the pivot element of the present invention on a racket head frame with string channel openings.

FIG. 2 shows a cross-sectional view corresponding to line 2-2 in FIG. 1 of a first embodiment of a pivot element 14 located partially within a substantially circular mating recess 18 on an outer-facing peripheral surface 32 of a head frame profile 28. The pivot element 14 is hollow and generally tubular and has a substantially circular profile. The element 14 has at least one string 8 laced through its central rotational axis 34 and is aligned with a central axis of the mating recess 18. In this particular embodiment a string 8 is shown laced through a string channel opening 24 in a head frame profile 28 and through a protective grommet 12 that is inserted in a string hole opening 30 in the pivot element 14. When ball impact on the string 8 occurs, a moment force is created around the central rotational axis 34 of the pivot element 14, forcing it to rotate within the mating circular recess 18 of the head frame profile 28.

An important way to affect the rotational efficiency of the pivot element 14 is by changing the diameter of its circular profile. A larger diameter will result in a larger moment force exerted around the central rotational axis 34 of the element 14 and therefore will rotate more easily than a smaller diameter element 14. However as the moment arm gets longer, the rate of rotation will slow down. It's clear that different string response qualities will be found with different sized pivot element(s) 14.

Figure 3:
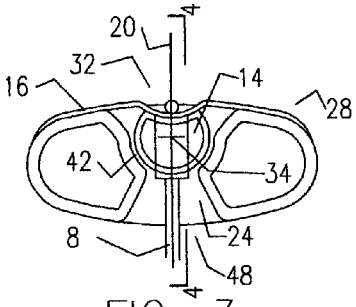
FIG. 3 shows a cross-sectional view corresponding to line 2-2 in FIG. 1 of the pivot element of the present invention including a protective bumper guard.

FIG. 3 shows a cross-sectional view corresponding to line 3-3 in FIG. 1 of a pivot element 14 including a protective bumper guard 16. The bumper guard 16 can be made integral with the grommet strip 12 in a typical fashion or it could be made separately and secured to the pivot element 14 and/or the head frame profile 28 in another way.

Figure 4:
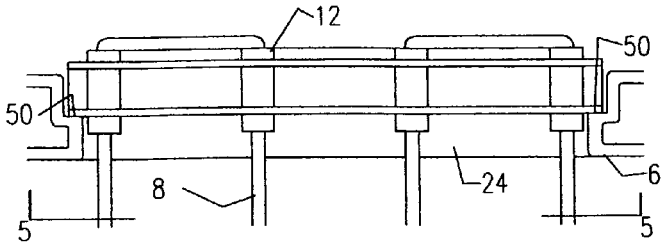
FIG. 4 shows a sectional view corresponding to line 44 in FIG. 2 of a number of pivot elements located on an outer-facing peripheral surface of a racket head frame.

FIG. 4 shows a sectional view corresponding to line 4-4 in FIG. 2 of a number of pivot element(s) 14 in sequence located partially within a substantially circular mating recess 18 on an outer-facing peripheral surface 32 of the head frame 6. This particular embodiment shows a sequence of pivot element(s) 14 spanning from one end of a string channel opening 24 to the other. The opposing end portions of the sequence of element(s) 14 rest on adjoining surface(s) 50 within the mating recess 18. To maximize rotation and efficiency of the element 14, the surface area of contact between the pivot element 14 and the mating recess 18 should be minimized. When there are adjoining surface(s) 50 between the element 14 and the mating recess 18, they can be coated with an anti-friction material such as silicone, in order to reduce friction when the element 14 rotates.

In this particular embodiment, the string channel opening 24 accommodates four string(s) 8, though the opening could be made to accommodate more or fewer string(s) 8 as desired.

Figure 5:
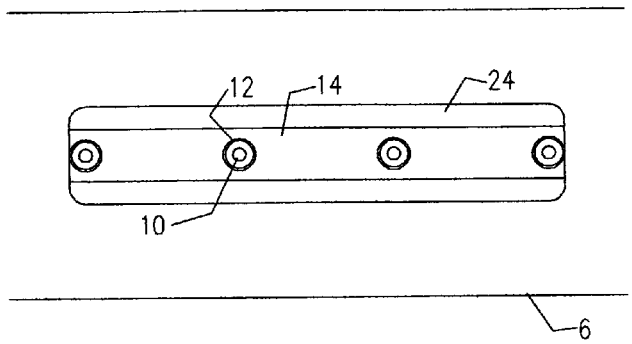
FIG. 5 shows a view corresponding to line 5-5 in FIG. 4 looking toward an inside-facing surface of a head frame.

A protective string grommet(s) 12 is shown here inserted through string hole opening(s) 30 in the pivot element 14 with a string 8 laced through. FIG. 5 is a view corresponding to line 5-5 in FIG. 4 looking at the inside-facing surface 48 of the head frame. The string(s) 8, which are shown in section, and grommet(s) 12 are viewed through an opening 24 in the head frame 6 and can be seen penetrating through the pivot element 14.

Figure 6:
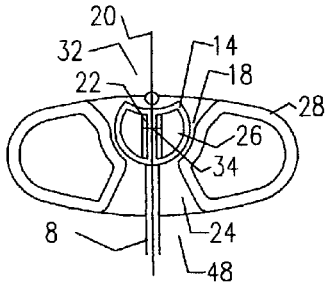
FIG. 6 shows a cross-sectional view corresponding to line 2-2 in FIG. 1 of a two-component pivot element profile located on an outside-facing peripheral surface of a racket head frame.

FIG. 6 shows a cross-sectional view corresponding to line 2-2 in FIG. 1 of a two-component 26 unitary, generally tubular and substantially circular pivot element 14 located partially within a substantially circular mating recess 18 on an outside-facing peripheral surface 32 of a racket head frame 6. This particular head frame profile 28 has a string channel opening 24 through which at least one string 8 can be laced. The separate component(s) 26 of the pivot element 14 can be bonded together as it is here with one common wall 38 and in a mating configuration that enables the pre-forming of string hole openings. This grommetless design is lightweight and is capable of providing a different kind of performance feedback.

Figure 7:
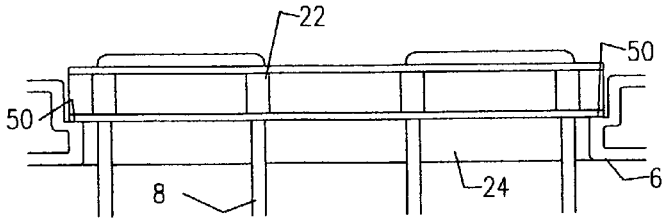
FIG. 7 shows a sectional view corresponding to line 44 in FIG. 2 of a number of pivot elements located on an outside-facing peripheral surface of a racket head frame.

FIG. 7 shows a sectional view corresponding to line 5-5 in FIG. 4 of a sequence of two-component unitary, generally tubular and substantially circular pivot element(s) 14 located partially within a substantially circular mating recess 18 on an outside-facing peripheral surface 32 of a racket head frame 6. This view shows two string 8 loops laced through a string channel opening 24 in the head frame 6 and through pre-formed string hole openings 22 in the pivot element 14. This design has minimal adjoining surface area 50 between the pivot element 14 and the head frame 6. When a string channel opening 24 is utilized as it is here, the sequence of pivot element(s) 14 can span from one end of the opening 24 to the other.

Figure 8:
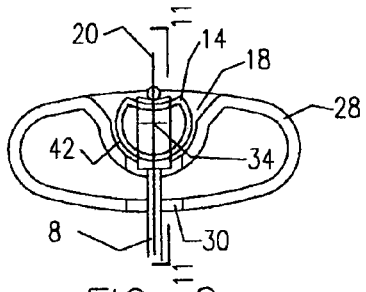
FIG. 8 shows a cross-sectional view corresponding to line 2-2 in FIG. 1 of a pivot element of the present invention on a racket head frame with string hole openings.

FIG. 8 shows a cross-sectional view corresponding to line 2-2 in FIG. 1 of a pivot element 14 on a head frame profile 28 including a string hole opening 30. The element 14 is located partially within a substantially circular mating recess 18 on an outer-facing peripheral surface 32 of the head frame profile 28. A string 8 is laced through a string hole opening 30 in the head frame profile 28 and through a protective string grommet 12 that's inserted in a string hole opening 30 in the pivot element 14.

Figure 9:
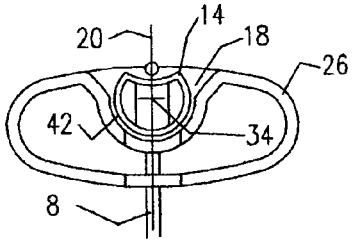
FIG. 9 is a cross-sectional view corresponding to line 8-8 in FIG. 9 of a pivot element on a head frame profile.

FIG. 9 is a cross-sectional view corresponding to line 2-2 in FIG. 1 of a pivot element 14 on a head frame profile 28. The cross-section is taken between string 8 lengths and therefore between string hole opening(s) 30, where the adjacent surface 42 area between the element 14 and the mating recess 18 is the greatest. This particular relationship between the element 14 and the recess 18 is well suited for an application in which controlling the rate of rotation of the pivot element 14 is the objective. In another embodiment of the present invention, the adjacent surface(s) 42 could be made to be adjoining surfaces 50 and therefore suitable for use as friction plates.

For example, the adjoining surface(s) 50 could include at least two opposite and facing electromagnets. The degree to which the adjoining surfaces 50 attract or repel could be controlled manually by altering the surrounding electrical current, or it could be controlled automatically via the piezoelectric effect in response to ball impact. Permanent magnets 44 could also be used to great effect on adjoining surface(s) 50 in this embodiment of the present invention. At least two opposite and facing permanent magnets could be used to produce levitation between the element 14 and the mating recess 18.

Figure 10:
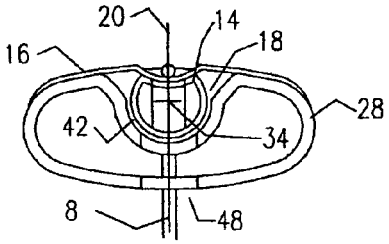
FIG. 10 is a cross-sectional view corresponding to line 2-2 in FIG. 1 showing the pivot element including a protective bumper guard.

FIG. 10 is a cross-sectional view corresponding to line 3-3 in FIG. 1 showing the pivot element 14 of this embodiment with a protective bumper guard 16. The bumper guard 16 can be integral with a grommet strip 12 or it could be formed separately and attached to the element 14 or the head frame profile 28 in some other way.

Figure 11:
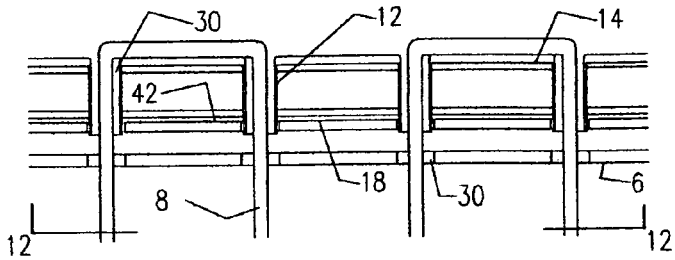
FIG. 11 is a sectional view corresponding to line 9-9 in FIG. 6 showing a number of pivot elements on an outer-facing peripheral surface of a racket head frame.

FIG. 11 is a sectional view corresponding to line 11-11 in FIG. 8 showing a number of pivot element(s) 14 in sequence located partially within a substantially circular mating recess 18 on an outer-facing peripheral surface 32 of the head frame 6. In this view, two string 8 loops can be seen laced through string hole opening(s) 30 in the head frame 6 and through string grommets(s) 12 that are inserted through a pivot element 14. As described in the previous figures this embodiment has substantial adjacent surface 42 area between the element 14 and the mating recess 18. The area could be made to be adjoining surface area 50 if desired.

Figure 12:
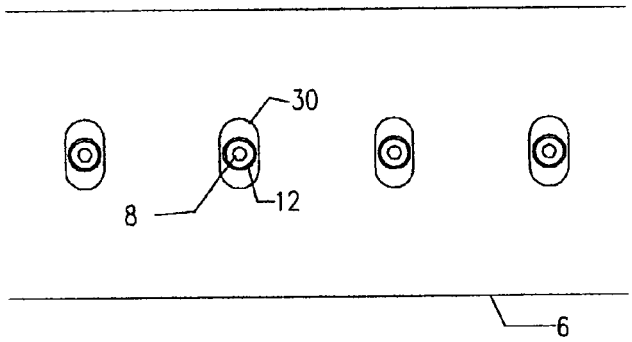
FIG. 12 is a view corresponding to line 10-10 in FIG. 9 looking toward an inside-facing surface of a head frame.

FIG. 12 is a sectional view corresponding to line 12-12 in FIG. 11 looking toward an inside-facing surface 48 of the head frame 6 showing more than one string 8 in section and penetrating through individual string hole opening(s) 30. The string hole openings 30 shown here are slot-like elongated circles, but the opening(s) 30 could just as easily be oversized hole openings.

Figure 13:
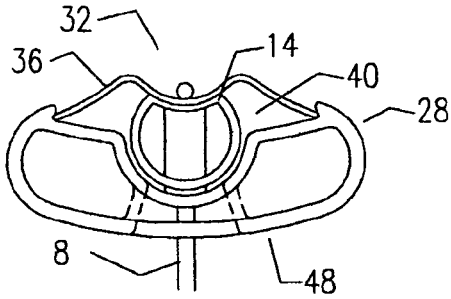
FIG. 13 shows a cross-sectional view corresponding to line 2-2 in FIG. 1 of one embodiment of a spring-loaded pivot element on an outside-facing surface of a racket head frame.

FIG. 13 shows a cross-sectional view corresponding to line 2-2 in FIG. 1 of one embodiment of a spring-loaded pivot element 14 located on an outside-facing peripheral surface 32 of a head frame profile 28. This particular pivot element 14 has a flexible wing 36 extending away from its central axis 20 in two directions perpendicular to a string 8 which can rest on an outer-facing peripheral surface 32 of a head frame profile 28. The wing(s) 36 can work as flexible levers to resist a moment force around the central rotational axis 34 of the pivot element 14 brought on by ball impact. A string 8 is shown laced through a grommet 12 in line with a central axis 20 of the pivot element 14 and the string 8. Although this illustration depicts a groove in the head frame profile 28 that receives the free ends of the two wing-like extensions, the wing(s) 36 ends could simply rest on the outer-facing peripheral surface 32 of the head frame profile 28 in a manner similar to the bumper guard 16 of previously described embodiments. In fact, the wing(s) 36 can perform the function of frame protection like a bumper guard 16 while also adding spring-like torsional resistance to the pivot element 14.

Figure 14:
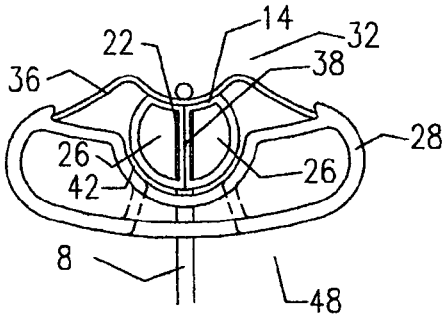
FIG. 14 shows a cross-sectional view corresponding to line 2-2 in FIG. 1 of a multi-component spring-loaded pivot element with pre-formed string hole openings located on an outside-facing portion of a racket head frame.

FIG. 14 shows a cross-sectional view corresponding to line 2-2 in FIG. 1 of a spring-loaded pivot element 14 on an outside-facing peripheral surface 32 of a head frame profile 28. The pivot element 14 of this embodiment is unique in that it can have pre-formed string hole opening(s) 22 thereby eliminating the need for a protective string grommet 12. Using the latest methods of inflation bladder molding in which a single unitary part can be made from separate components, the substantially circular, generally tubular pivot element 14 can be made of more than one component 26. In this particular design, the substantially circular profile of the pivot element 14 is formed by two component(s) 26. The component(s) 26 can be joined together in such a way as to form string channel openings 22 by virtue of their mating configuration. This particular pivot element 14 can be generally lighter and is capable of providing superior feedback than one utilizing a more typical drilled string hole 30 and grommet 12. The wing(s) 36 can be molded separately and bonded/co-cured to the substantially circular central portion of the element 14.

Figure 15:
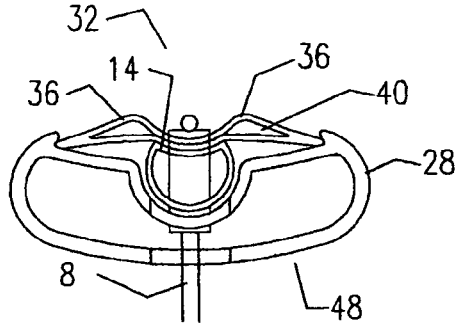
FIG. 15 shows a cross-sectional view corresponding to line 2-2 in FIG. 1 of a third embodiment of a spring-loaded pivot element including an integral chamber located on an outer-facing surface of a racket head frame.

FIG. 15 shows a cross-sectional view corresponding to line 2-2 in FIG. 1 of a third embodiment of a spring-loaded pivot element 14. This particular element 14 has 2 wing(s) 36 extending away from its central axis 20 in two directions perpendicular to a string 8, which rest on an outside-facing peripheral surface 32 of a head frame profile 28. The 2 wing(s) of this arrangement form a chamber 40 that can be utilized to affect the flexural capacity of the wing 36 and therefore the capacity of the pivot element 14 to resist a moment force brought on by ball impact. In this particular embodiment a string 8 is shown laced through a grommet 12 that's inserted through the pivot element 14 however, the design could just as easily be made from more than one component 26 to have pre-formed string hole openings 22 thereby eliminating the need for a protective string grommet 12.

Figure 16:
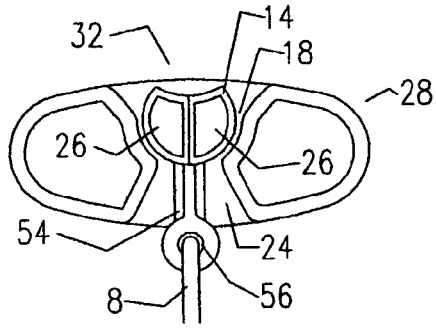
FIG. 16 shows a cross-sectional view corresponding to line 2-2 in FIG. 1 of a further embodiment of a pivot element including a lever arm extension located on an outer-facing surface of a racket head frame.

FIG. 16 shows a cross-sectional view corresponding to line 2-2 in FIG. 1 of a two-component 26 pivot element 14 located partially within a substantially circular mating recess 18 on an outside-facing peripheral surface 32 of a head frame profile 28. The pivot element 14 includes a lever arm extension 54 that can have a connecting aperture 56 which is aligned with its central rotational axis 34 and can be laced through with a string 8. A lever arm extension 54 can greatly increase the moment force created around the central rotational axis 34 of a pivot element 14 upon ball impact.

Figure 17:
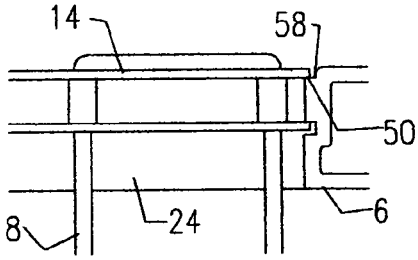
FIG. 17 is a sectional view corresponding to line 11-11 in FIG. 8 showing an end of a pivot element resting on a pivot pin within a portion of a mating recess.
Figure 18:
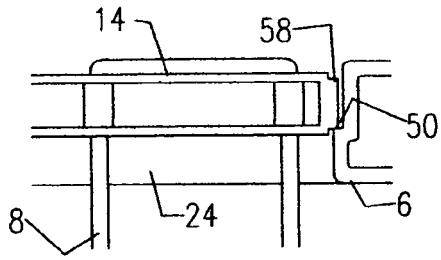
FIG. 18 is a sectional view corresponding to line 11-11 in FIG. 8 showing an end of a pivot element having a pivot pin resting within a portion of a mating recess.

FIGS. 17 and 18 show sectional views corresponding to line 11-11 in FIG. 8 of the last of a sequence of pivot element(s) 14 located partially within a mating recess 18 on the head frame 6. In the particular embodiments shown here, the end of the last element 14 is resting on a portion of the head frame 6 at the mating recess 18. FIG. 17 shows the recess 18 having a substantially circular pivot pin 58 upon which the pivot element 14 can rest and rotate. An adjoining surface area 50 is shown between the outer facing portion of the pin 58 and pivot element 14. FIG. 18 shows the pivot element 14 having a pivot pin 58 at its end which can rest on a portion of the substantially circular mating recess 18. An adjoining surface area 50 is shown between the inner facing portion of the pin 58 and a portion of the mating recess 18.

Though the drawings are intended to describe some of the preferred embodiments of the invention, the scope of the ideas embodied in them should not be limited merely to the drawings themselves but rather considered a representational depiction. Other variations are possible and will become apparent to those skilled in the art. Accordingly, the present invention is not intended to be limited by the recitation of embodiments, but is intended to be defined by reference to the appended claims.

parts list:

2 racket
4 handle
6 head frame
8 string
10 stringed hitting surface
12 grommet/grommet strip
14 pivot element
16 protective bumper guard
18 mating recess
20 central axis
22 pre-formed string hole opening
24 string channel opening
26 component
28 head frame profile
30 string hole opening
32 outside-facing peripheral surface
34 central rotational axis
36 wing
38 common wall
40 chamber
42 adjacent surface area
44 communicating friction plate
46 dampening/elastomeric material
48 inside-facing surface
50 adjoining surface area
52 pivot element profile
54 lever arm extension
56 connecting aperture
58 pivot pin

What is claimed is:

1. A game racket, comprising:

a handle and a head frame;

a stringed hitting surfaced formed by at least one string held in tension and laced through the head frame;

at least one hollow and tubular pivot element located on at least a portion of an outside-facing peripheral surface in a closed profile of the head frame, wherein the pivot element has more than one string opening and is a substantially circular profile located at least partially within a substantially circular mating recess and having a central axis aligned with a central axis of the string.

2. The racket according to claim 1, further comprising:

at least one string hole pre-formed in the pivot element by a combination of two or more hollow components abutting at a juncture that lies in a plane parallel to a plane in which the stringed hitting surface lies.

3. The racket according to claim 1, further comprising:

a protective bumper guard integrated with a grommet strip in the pivot element.

4. The racket according to claim 1, wherein the pivot element includes a connecting lever arm extension that holds a string.

5. The racket according to claim 4, wherein the lever arm extension is a through-hole connecting aperture for a string.

6. The game racket according to claim 1, further comprising:

at least one wing extending away from the central axis of the pivot element in two directions perpendicular to the string and resting upon an outside-facing peripheral surface of the head frame; wherein, the pivot element flexibly resists rotation to cooperate with at least one string.

7. The racket according to claim 6 wherein the pivot element profile rests upon at least a portion of the mating recess to have at least one adjoining surface.

8. The racket according to claim 6, further comprising:

at least one string hole pre-formed in the pivot element by a combination of two or more hollow components abutting at a juncture that lies in a plan parallel to a plane in which the string hitting surface lies.

9. The racket according to claim 6, further comprising:

a protective bumper guard created by the wing(s).

10. The racket according to claim 6, further comprising:

a connecting lever arm extension for a string attached to the pivot element.

11. The racket according to claim 6, further comprising:

a through-hole connecting aperture for a string attached to the lever arm extension.

12. The racket according to claim 6, further comprising:

a substantially enclosed chamber formed by the wing in relation to an outside-facing peripheral surface of the head frame.

13. The racket according to claim 12, further comprising:

at least one portion of a dampening or elastomeric material included in the chamber.

14. The racket according to claim 6, further comprising:
two wings extending away from a central axis of the pivot element in two directions perpendicular to a central axis of the string to form a substantially enclosed chamber.

15. The racket according to claim 14, comprising;
at least one portion of a dampening and/or elastomeric material included in the chamber.

16. The racket according to claim 1, further comprising:
a mating recess, a portion of which the pivot element rests on to have at least one adjoining surface with the head frame.

17. The racket according to claim 1, further comprising:
a male/female pin-type connection with the head frame at opposing ends of one or a sequence of the pivot element(s) to form the adjoining surface.

18. The racket according to claim 1, further comprising:
at least two opposite and facing repelling permanent magnets included in the a portion of the adjoining surface.

19. The racket according to claim 1, further comprising:
communicating electromagnetic friction plates included in a portion of the adjoining surface.

20. The racket according to claim 19, further comprising:
an electronic current induced automatically via the piezoelectric effect to inform the electromagnetic friction plates.

21. The racket according to claim 19; further comprising:
an electronic current induced manually to inform the electromagnetic plates.

22. The racket according to claim 1, wherein:
the pivot element is one continuous piece that rotates to cooperate with one or more strings that thread through the pivot element.

* * * * *